US011106177B1

(12) United States Patent
Nomura et al.

(10) Patent No.: US 11,106,177 B1
(45) Date of Patent: Aug. 31, 2021

(54) PARTICLE COLLECTING DEVICE AND IMAGE FORMING APPARATUS

(71) Applicant: FUJIFILM Business Innovation Corp., Tokyo (JP)

(72) Inventors: Yuka Nomura, Kanagawa (JP); Tetsuya Kawatani, Kanagawa (JP); Yutaka Nakayama, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/921,915

(22) Filed: Jul. 6, 2020

(30) Foreign Application Priority Data

Mar. 18, 2020 (JP) ..... JP2020-047654

(51) Int. Cl.
*G03G 21/20* (2006.01)

(52) U.S. Cl.
CPC ..... *G03G 21/206* (2013.01)

(58) Field of Classification Search
CPC ..... G03G 21/206
See application file for complete search history.

(56) References Cited

U.S. PATENT DOCUMENTS

2009/0010815 A1* 1/2009 Murata ..... B01D 53/945 422/171

FOREIGN PATENT DOCUMENTS

| | | |
|---|---|---|
| JP | 2008008151 | 1/2008 |
| JP | 2012-032663 | 2/2012 |
| JP | 2018-049189 | 3/2018 |

* cited by examiner

*Primary Examiner* — Thomas S Giampaolo, II
(74) *Attorney, Agent, or Firm* — JCIPRNET

(57) ABSTRACT

A particle collecting device includes: an air pipe having a flow space in which air including particles flows; and a collecting unit that is disposed in such a way as to block the flow space of the air pipe and that collects the particles included in the air. The collecting unit is a plate-shaped air-permeable member having a honeycomb structure such that a number of cells per square inch is 600 or larger and 1400 or smaller.

17 Claims, 9 Drawing Sheets

PARTICLE COLLECTING DEVICE AND IMAGE FORMING APPARATUS

CROSS-REFERENCE TO RELATED APPLICATIONS

This application is based on and claims priority under 35 USC 119 from Japanese Patent Application No. 2020-047654 filed Mar. 18, 2020.

BACKGROUND

(i) Technical Field

The present disclosure relates to a particle collecting device and an image forming apparatus.

(ii) Related Art

Japanese Unexamined Patent Application Publication No. 2008-8151 (claim 1, FIG. 1, and others) describes a honeycomb structure that is a second honeycomb structure used in an air discharging system of an internal combustion engine in which at least one or more first honeycomb structures and at least one or more second honeycomb structures are disposed. The honeycomb structure has a pressure loss smaller than a pressure loss of one of the first honeycomb structures, and includes two or more electrodes.

Japanese Unexamined Patent Application Publication No. 2012-32663 (claim 1, paragraph 0027, FIG. 2, and others) describes an image forming apparatus that fixes a toner image, which has been transferred onto a sheet in an image forming unit, by heating and pressing the toner image in a fixing unit. The image forming apparatus includes a fan for discharging cooling air, which has been used to cool the fixing unit, from the fixing unit; an air discharging duct for discharging the cooling air, which has been discharged from the fixing unit, to the outside of the apparatus; and a filter unit disposed in the air discharging duct. The filter unit includes a filter that is impregnated with silicone oil. Japanese Unexamined Patent Application Publication No. 2012-32663 also shows examples of the shape of the silicone impregnated filter, such as a honeycomb shape.

SUMMARY

Aspects of non-limiting embodiments of the present disclosure relate to a particle collecting device and an image forming apparatus using the particle collecting device. The particle collecting device is capable of collecting and reducing ultra-fine particles having a particle diameter of 100 μm or smaller while suppressing pressure loss, compared with a case where a plate-shaped air-permeable member having a honeycomb structure such that the number of cells per square inch or the opening ratio per square inch is in a specific numerical range is not used as a collecting unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a particle collecting device including: an air pipe having a flow space in which air including particles flows; and a collecting unit that is disposed in such a way as to block the flow space of the air pipe and that collects the particles included in the air. The collecting unit is a plate-shaped air-permeable member having a honeycomb structure such that a number of cells per square inch is 600 or larger and 1400 or smaller.

BRIEF DESCRIPTION OF THE DRAWINGS

An exemplary embodiment of the present disclosure will be described in detail based on the following figures, wherein:

FIG. 5 is a schematic view illustrating a test method used in a test T1 and the like;

DETAILED DESCRIPTION

Hereafter, an exemplary embodiment of the present disclosure will be described with reference to the drawings.

Exemplary Embodiment

Figure 1:
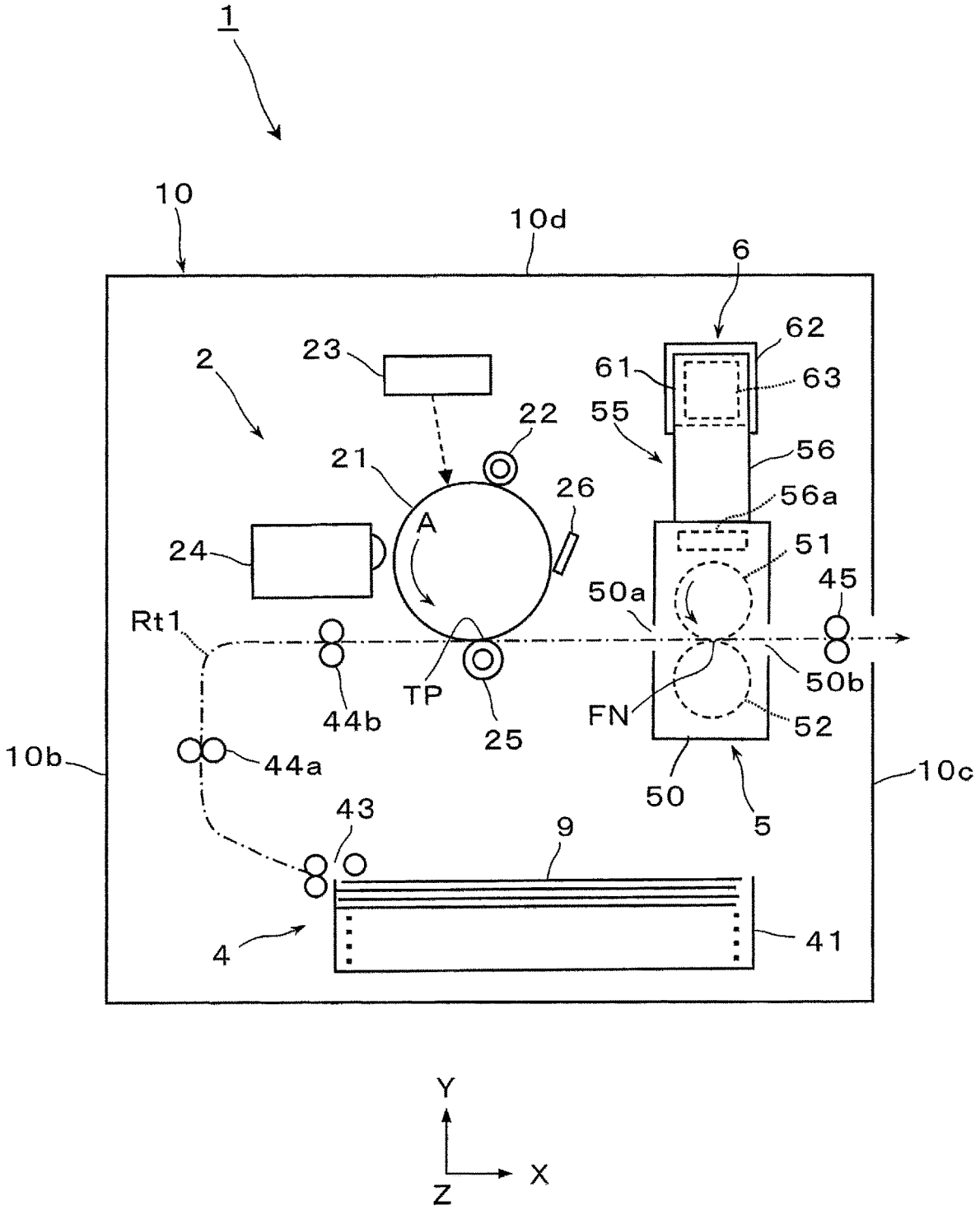
FIG. 1 is a schematic view illustrating the entirety of an image forming apparatus according to the exemplary embodiment.
Figure 2:
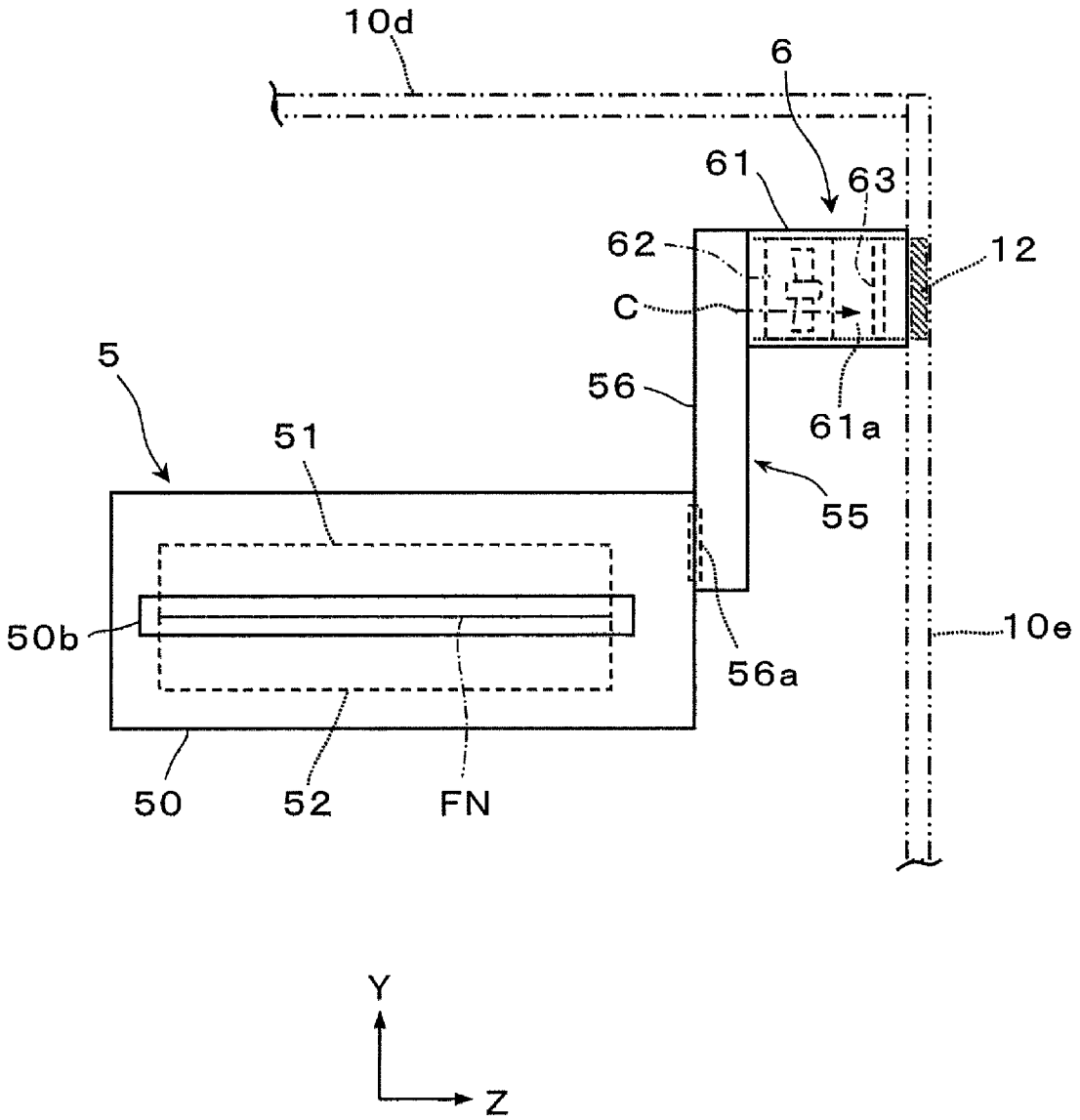
FIG. 2 is a schematic view illustrating the configurations of a fixing device and a particle collecting device of the image forming apparatus of FIG. 1.

FIGS. 1 and 2 illustrate an image forming apparatus and a particle collecting device according to an exemplary embodiment of the present disclosure. FIG. 1 illustrates the entirety of the image forming apparatus, and FIG. 2 illustrates a part (including a fixing device and the particle collecting device) of the image forming apparatus.

In FIG. 1 and other figures, arrows X, Y, and Z respectively indicate the width direction, the height direction, and the depth direction of a three-dimensional space assumed for each of the figures. In each of the figures, a blank circle at the intersection of the arrow X and the arrow Y indicates that the arrow Z extends into the plane of the figure.

Image Forming Apparatus

FIG. 1 illustrates an image forming apparatus 1 that forms an image on a sheet 9, which is an example of a recording medium, by using, for example, an electrophotographic method. The image forming apparatus 1 forms an image corresponding to, for example, image information that is input from an external device such as an information terminal. Here, the term "image information" refers to information related to an image to be formed, such as a character, a figure, a photograph, a pattern, or the like.

Referring to FIG. 1, the image forming apparatus 1 includes: a housing 10, which is an example of an apparatus body; and an image forming device 2, a sheet feeding device 4, a fixing device 5, a particle collecting device 6, and the like, which are disposed in the housing 10.

The housing 10 is made from components, such as support members and exterior members, so as to have desirable shape and structure. In FIG. 1, a chain line with an arrow indicates a transport path along which the sheet 9 is transported in the housing 10.

The image forming device 2 forms a toner image, which is composed of toner as a developer, based on image information and transfers the toner image to the sheet 9. The image forming device 2 includes: an photoconductor drum 21, which is an example of an image carrier and which rotates in the direction indicated by an arrow A; and a charging device 22, an exposure device 23, a developing device 24, a transfer device 25, a cleaning device 26, and the like, which are disposed around the photoconductor drum 21.

The charging device 22 charges the outer peripheral surface (image forming surface) of the photoconductor drum 21 to a desirable surface potential. The charging device 22 includes, for example, a charging member such as a roller that is in contact with an image forming region of the outer peripheral surface of the photoconductor drum 21 and to which a charging electric current is supplied. The exposure device 23 forms an electrostatic latent image on the outer peripheral surface of the photoconductor drum 21, which has been charged, by exposing the outer peripheral surface to light based on image information. The exposure device 23 is operated based on an image signal that is generated by an image processor (not shown) by performing a desirable image processing operation on image information that is input from the outside.

The developing device 24 develops the electrostatic latent image, which has been formed on the outer peripheral surface of the photoconductor drum 21, into a monochrome toner image by using developer (toner) having a predetermined color (for example, black). The transfer device 25 electrostatically transfers the toner image, which has been formed on the outer peripheral surface of the photoconductor drum 21, to the sheet 9. The transfer device 25 includes a transfer member such as a transfer roller that is in contact with the outer peripheral surface of the photoconductor drum 21 and to which a transfer electric current is supplied. The cleaning device 26 cleans the outer peripheral surface of the photoconductor drum 21 by scraping off waste substances that adhere to the outer peripheral surface of the photoconductor drum 21, such as residual toner, paper dust, and the like.

In the image forming device 2, a position at which the photoconductor drum 21 and the transfer device 25 face each other is a transfer position TP where transfer of a toner image is performed.

The sheet feeding device 4 stores sheets 9, which are to be supplied to the transfer position TP in the image forming device 2, and feeds the sheets 9. The sheet feeding device 4 includes a container 41 that stores the sheets 9, a feeding device 43 that feeds the sheets 9, and the like.

The container 41 includes a stacking plate (not shown) on which plural sheets 9 are stacked in a desirable orientation. The container 41 is attached to the housing 10 in such a way that a user can perform, for example, an operation of supplying sheets 9 by pulling the container out of the housing 10. The feeding device 43 feeds the sheets 9, which are stacked on the staking plate of the container 41, one by one by using a feeding mechanism having plural rollers or the like.

The sheet 9 may be any recording medium, such as plain paper, coated paper, or cardboard, that can be transported in the housing 10 and to which a toner image can be transferred and fixed. The material, the shape, and the like of the sheet 9 are not particularly limited.

The fixing device 5 fixes a toner image, which has been transferred at the transfer position TP in the image forming device 2, to the sheet 9. The fixing device 5 includes: a housing 50 having an input opening 50*a* and an output opening 50*b* for the sheet 9; and a heating rotational body 51, a pressing rotational body 52, and the like, which are disposed in the housing 50.

The heating rotational body 51 may be a roller, a belt-pad, or the like that rotates in the direction indicated by an arrow. The heating rotational body 51 is heated by a heater (not shown) so that the temperature of the outer surface thereof is maintained at a desirable temperature. The pressing rotational body 52 may be a roller, a belt-pad, or the like that is rotated by or rotates the heating rotational body 51 by being pressed against the heating rotational body 51 with a desirable pressure. The pressing rotational body 52 may be heated by a heater.

In the fixing device 5, a portion at which the heating rotational body 51 and the pressing rotational body 52 are in contact with each other is a fixing-operation portion (nip) FN where operations such as a heating operation and a fixing operation for fixing an unfixed toner image to the sheet 9 are performed.

In FIG. 1, the chain line represents a sheet transport path Rt1 along which the sheet 9 is transported from the sheet feeding device 4 and supplied to the transfer position TP. In the sheet transport path Rt1, plural transport rollers 44*a* and 44*b* that nip the sheet 9 therebetween and transport the sheet 9, guide members (not shown) that provide a transport space for the sheet 9 and guide transporting of the sheet 9, and the like are disposed.

The image forming apparatus 1 performs an image forming operation, for example, as follows.

When a controller (not shown) of the image forming apparatus 1 receives an instruction for performing an image forming operation, the image forming device 2 performs a charging operation, an exposure operation, a developing operation, and a transfer operation, while the sheet feeding device 4 performs a sheet feeding operation of feeding the sheet 9 to the transfer position TP. Thus, a toner image is formed on the photoconductor drum 21, and the toner image is transferred from the sheet feeding device 4 to the sheet 9 supplied to the transfer position TP.

Next, the fixing device 5 of the image forming apparatus 1 performs a fixing operation in which the sheet 9, on which the toner image has been transferred, is guided into and passes through the nip FN. Thus, the unfixed toner image is fixed to the sheet 9. The sheet 9, on which the toner image has been fixed, is discharged by, for example, an output roller 45 to a container (not shown) disposed outside of the housing 10.

Thus, the image forming apparatus 1 finishes the image forming operation of forming an image on one side of the sheet 9.

Particle Collecting Device

The particle collecting device 6 collects particles generated in the fixing device 5 and the surrounding components. Referring to FIGS. 1 to 3B and other figures, the particle collecting device 6 includes an air pipe 61, an airflow generating unit 62, a collecting unit 63, and the like.

The particle collecting device 6 collects ultra-fine particles (UFPs) having a particle diameter of 100 nm (0.1 μm) or smaller.

The particle collecting device 6 collects, for example, ultra-fine particles that are included in particles (dust particles) that are generated when wax and other materials of toner are vaporized by heat during a fixing process (fixing operation) and then cooled.

The air pipe 61 has a flow space 61*a* in which air including particles flows.

Figure 3A:
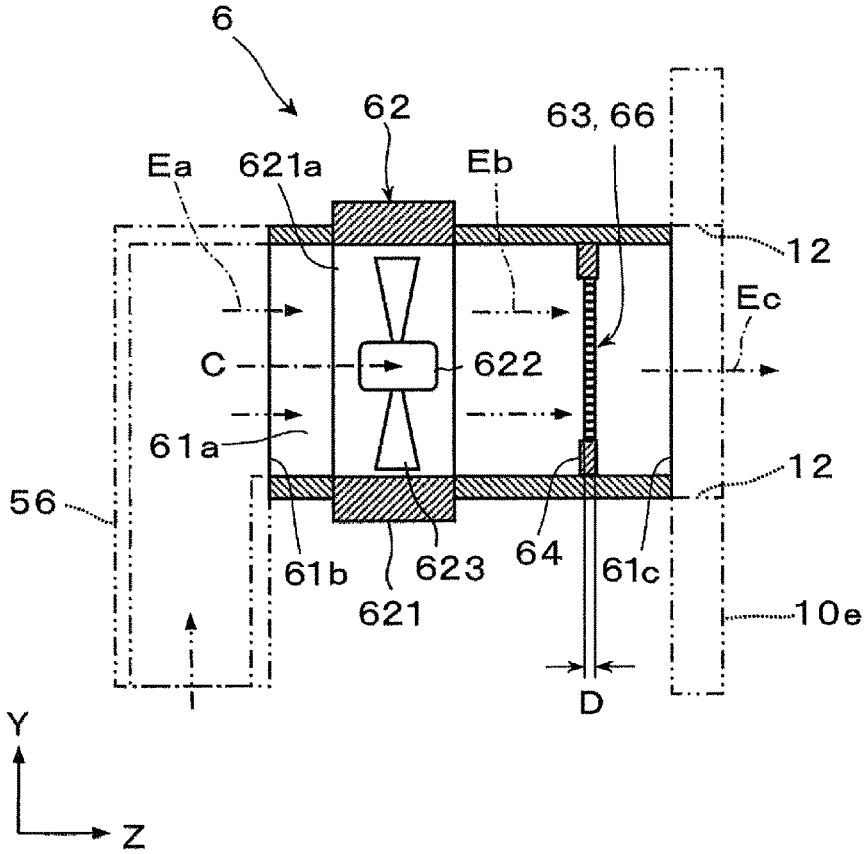
FIG. 3A is a schematic view illustrating the particle collecting device of FIG. 2.

The air pipe 61 in the exemplary embodiment is a rectangular pipe in which the flow space 61*a* has a substantially rectangular cross-sectional shape. Referring to FIGS. 2 and 3A, one end portion 61*b* of the air pipe 61 is connected to a suction duct 56 of an air discharging mechanism 55, which is an example of an air discharging unit, disposed on a side portion of the housing 50 of the fixing device 5. The other end portion 61*c* of the air pipe 61 is connected to an air-discharge opening 12 of the air discharging mechanism 55, which is formed in a back portion 10*e* of the housing 10. The suction duct 56 sucks air that is present in the housing 50 and the surrounding area through a suction opening 56*a*, which is located above the input opening 50*a* and the output opening 50*b* for the sheet 9, of the housing 50 of the fixing device 5. In FIG. 2, the numeral 10*d* represents an upper portion of the housing 10.

The airflow generating unit 62 generates airflow for causing air to flow in the flow space 61*a* of the air pipe 61 in a direction C in which the air is to be moved.

In the exemplary embodiment, an axial fan is used as the airflow generating unit 62. Referring to FIG. 3A, the axial fan includes, for example, a frame 621 in which a through-portion 621*a* having a circular cross-sectional shape is formed, a shaft 622 that is rotatably supported in the through-portion 621*a* of the frame 621 and in which a driving motor (not shown) is disposed, and plural blades 623 that are disposed so as to stand around the shaft 622.

The intensity (the airflow rate or the airflow speed) of airflow generated by the airflow generating unit 62 may be appropriately determined in view of, for example: prevention of secondary problems, such as increase of temperature and occurrence of condensation inside the housing 10 of the image forming apparatus 1 (in the present example, particularly the inside of the housing 50 of the fixing device 5) and increase of operation noise; and achievement of high particle-collecting performance of the collecting unit 63. As can be seen from the test results described below, the UFP reduction ratio (collection efficiency) tends to increase as the airflow rate increases. Therefore, for example, the airflow rate on a side of the collecting unit 63 into which air flows may be 0.2 $m^3$/min or higher.

The collecting unit 63 is disposed across the flow space 61*a* in a middle part of the air pipe 61 and collects particles included in air that flows in the flow space 61*a*.

Figure 3B:
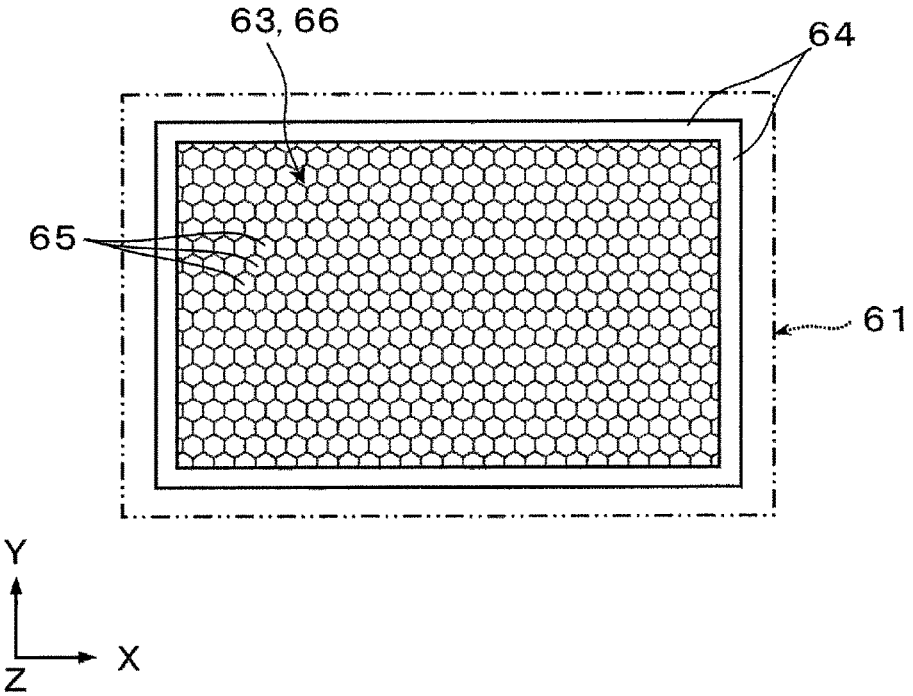
FIG. 3B is a schematic view illustrating a plate-shaped air-permeable member that is a collecting unit of the particle collecting device.

Referring to FIG. 3B and other figures, the collecting unit 63 in the exemplary embodiment includes a plate-shaped air-permeable member 66 having a honeycomb structure such that the number of cells 65 per square inch is 600 or larger and 1400 or smaller. Referring to the partially enlarged view in FIG. 4, the plate-shaped air-permeable member 66 is, for example, a metal filter having a honeycomb structure such that the cells 65, each having a substantially hexagonal cross-sectional shape, are tightly arranged.

Here, each of the cells 65 is a minimum unit of the repeating pattern of the honeycomb structure, and has a hollow tubular structure extending through the honeycomb structure while maintaining a uniform cross-sectional shape. The number of the cells 65 per square inch is counted, for example, by performing image processing analysis or by using a tool such as a magnifying glass.

Referring to FIGS. 3A and 3B, the collecting unit 63, which includes the plate-shaped air-permeable member 66 having the honeycomb structure, is, for example, fixed to the inside of the flow space 61*a* of the air pipe 61 in a state of being attached to and supported by a frame 64 having an air-permeable region.

The plate-shaped air-permeable member 66, which is a metal filter, is manufactured by using a metal material such as aluminum. It is not necessary to apply a material having a function of improving the ultra-fine-particle collection performance or the like to the surface of the collecting unit 63, which is a metal filter having the honeycomb structure, and the metal surface may be exposed as it is.

If the number of the cells 65 is smaller than 600, the surface area is small and it is difficult to obtain sufficient ultra-fine-particle collection performance. If the number of the cells 65 is larger than 1400, it is difficult to suppress pressure loss and to manufacture (process) a plate-shaped air-permeable member having a honeycomb structure with such a number of cells.

In view of suppression of pressure loss and achievement of sufficiently high collection efficiency, the number of the cells 65 may be 900 or larger and 1000 or smaller.

The thickness D of the collecting unit 63, which includes the plate-shaped air-permeable member 66 having the honeycomb structure, may have any appropriate value. However, the thickness D may be 3 mm or larger and 9 mm or smaller, and further, may be 5 mm or larger and 7 mm or smaller.

Here, the thickness D is the dimension of the collecting unit 63 in the direction in which the cells 65 extend through the collecting unit 63 or the direction in which air passes through the collecting unit 63. If the thickness D is smaller than 3 mm, the surface area of each of the cells 65 in the direction in which air passes is small, and it is difficult to obtain sufficiently high ultra-fine-particle collection performance. If thickness D is larger than 9 mm, it is difficult to suppress pressure loss.

Figure 4:
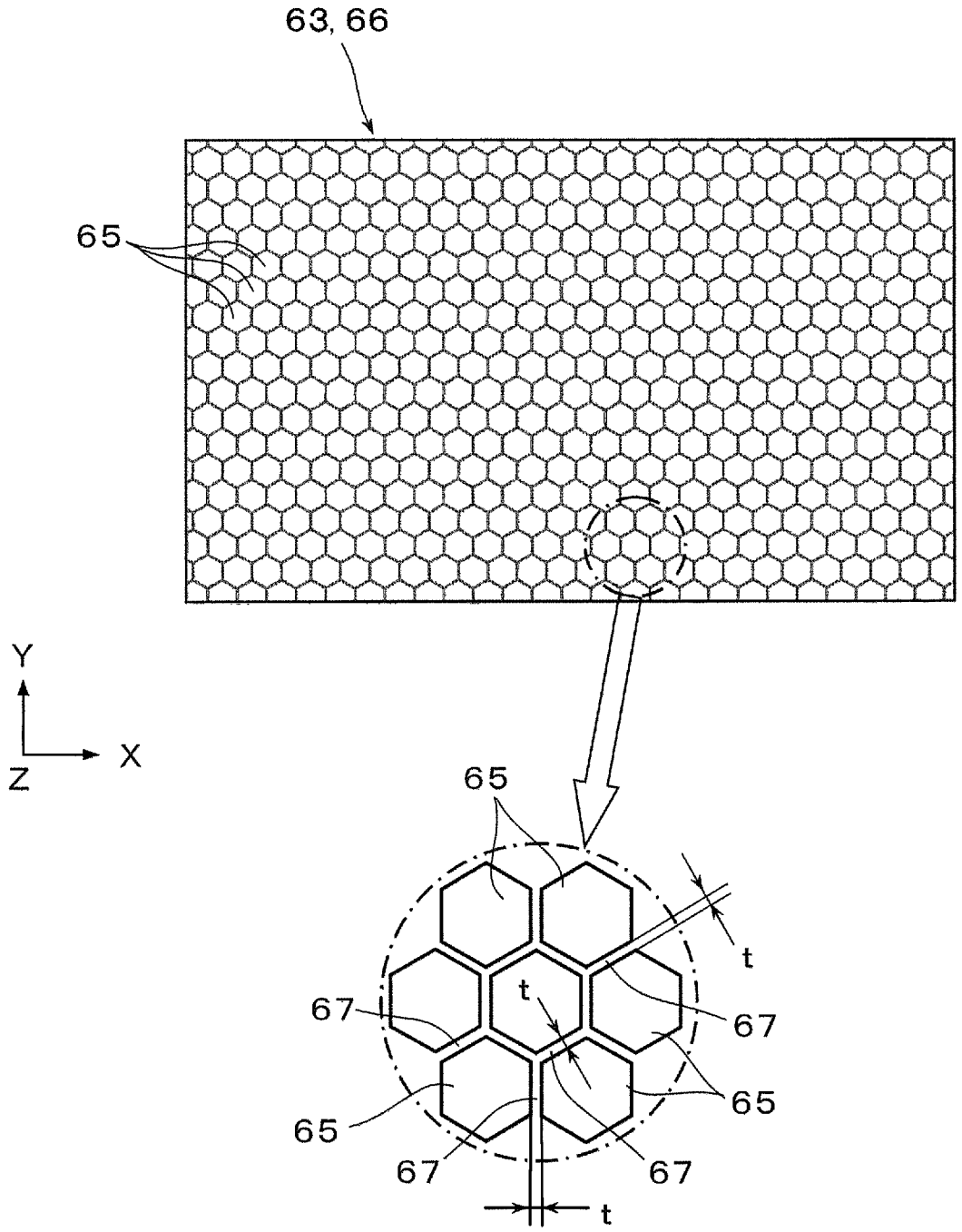
FIG. 4 shows a schematic view and a partial enlarged view of the air-permeable member of FIG. 3B.

Referring to the enlarged view of FIG. 4, in the collecting unit 63, the thickness t of a boundary portion 67 between the cells 65 of the honeycomb structure is 0.015 mm or larger and 0.02 mm or smaller.

If the thickness t of the boundary portion 67 is smaller than 0.015 mm, it is difficult to manufacture the plate-shaped air-permeable member of the collecting unit 63, and it is difficult to maintain the shape of the honeycomb structure due to insufficient strength of the plate-shaped air-permeable member. If the thickness t of the boundary portion 67 is larger than 0.02 mm, it is difficult to form a honeycomb structure such that the number of the cells 65 is in the aforementioned range.

Referring to FIGS. 2 and 3A, in the particle collecting device 6, the collecting unit 63 is disposed at a position in the air pipe 61 downstream of the airflow generating unit 62 in the direction C in which air is moved in the flow space 61*a* of the air pipe 61. In view of suppressing gap leakage between the frame 64 and the air pipe 61, the collecting unit 63 may be disposed at a position in the air pipe 61 upstream of the airflow generating unit 62 in the direction C in which air flows in the air pipe 61.

The particle collecting device 6 operates, for example, at least when the fixing device 5 is operating and for a predetermined period after the fixing device 5 has stopped operating.

That is, referring to FIG. 3A, when the particle collecting device 6 operates, the airflow generating unit 62 is activated, and airflow in the direction of an arrow C is generated in the flow space 61*a* of the air pipe 61.

Thus, air including particles generated in a fixing operation of the fixing device 5 flows into the flow space 61*a* of the air pipe 61 via the suction duct 56. Air Ea including particles, which has flowed into the flow space 61*a*, passes through the axial fan of the airflow generating unit 62 and is moved to the front side of the collecting unit 63 as unfiltered air Eb.

Referring to FIG. 3A, the unfiltered air Eb including particles, which has been moved to the front side of the collecting unit 63, collides with the plate-shaped air-permeable member 66, having the honeycomb structure, of the collecting unit 63 and moves so as to pass through the cells 65 of the honeycomb structure.

That is, the unfiltered air Eb passes through the cells 65 of the plate-shaped air-permeable member 66 while colliding with the air-permeable member 66 (metal filter) having the honeycomb structure such that the number of the cells 65 per square inch is 600 or larger and 1400 or smaller.

Thus, at least some of ultra-fine particles that are included in the unfiltered air Eb and that have a particle diameter of 100 nm or smaller adhere to the cells 65 of the honeycomb structure of the plate-shaped air-permeable member 66 and are collected. As a result, compared with the unfiltered air Eb, ultra-fine particles included in filtered air Ec that has passed through the collecting unit 63 are reduced.

Lastly, the filtered air Ec is discharged to the outside from the air-discharge opening 12 of the housing 10 of the image forming apparatus 1.

Tests Related to Collection Efficiency

Next, a test T1 performed to examine the collection efficiency of the particle collecting device 6 will be described.

The test T1 related to the collection efficiency is performed based on the test standards (RAL-UZ205) of Blue Angel mark, which is the German ecolabel.

Figure 5:
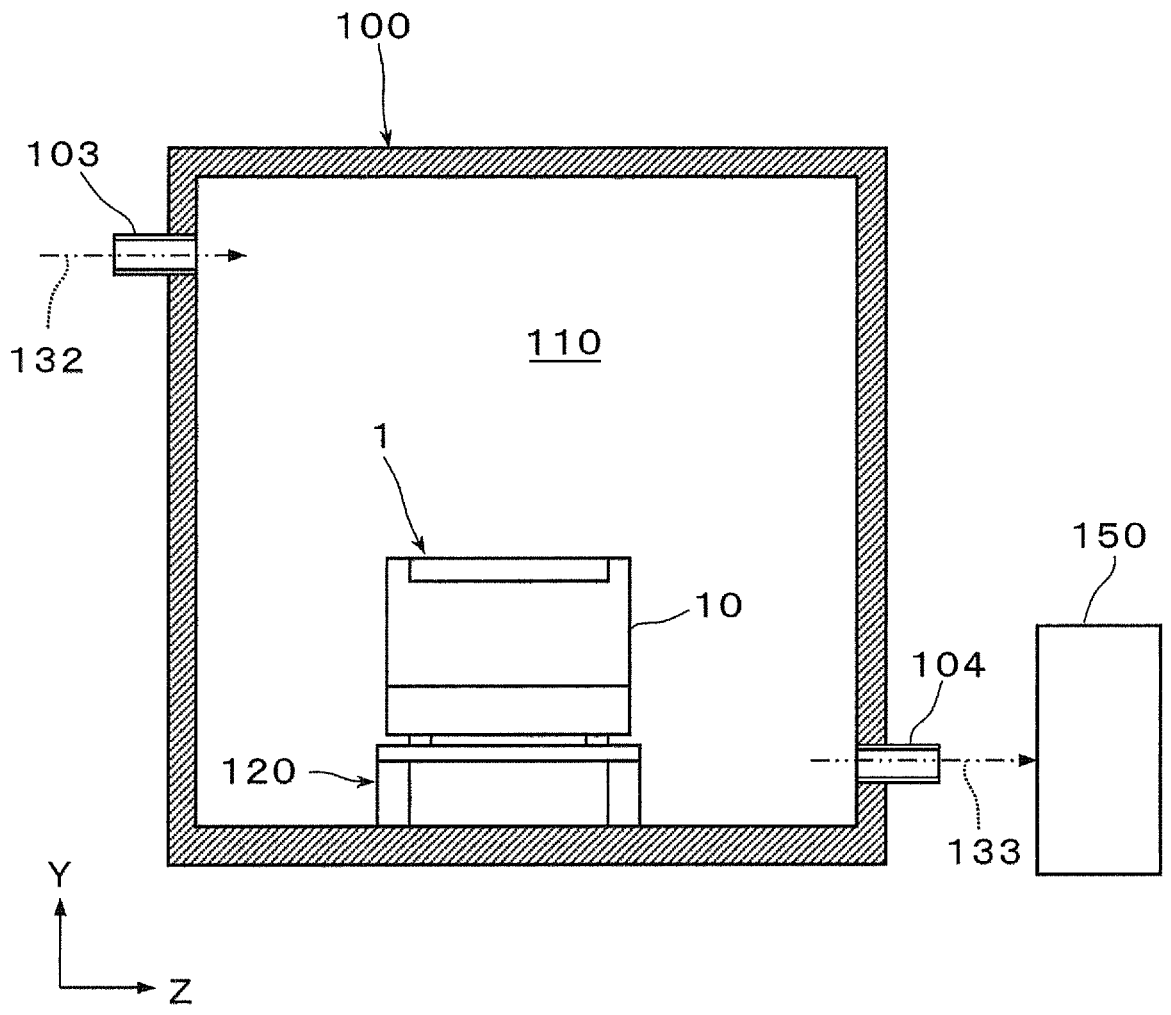

Referring to FIG. 5, the test T1 is performed as follows: the image forming apparatus 1 to be measured is placed on a placement base 120 disposed in a space 110 of a test chamber 100, which is a hermetically-closed test environment chamber, so as to be in equilibrium; the image forming apparatus 1 is activated, and a predetermined image forming operation is performed for one minute; and the amount of ultra-fine particles (UFP) included in air in the indoor space and the like during the image forming operation and in a predetermined period after stopping the operation is measured by using a measuring device 150 (Condensation Particle Counter CPC Model 3775, made by TSI Incorporated). In the test T1, the test chamber 100 is set to be in a predetermined indoor environment (temperature: 23° C., humidity: 50% RH).

The test chamber 100 has an indoor space having a volume of, for example, 5.1 $m^3$. Clean air 132 is supplied to the indoor space from an air-supply opening 103, and indoor air 133 is discharged from an air-discharge opening 104. The indoor air 133 discharged from the test chamber 100 is moved to the measuring device 150 connected to the test chamber 100.

The image forming apparatus 1 to be measured is combined with the particle collecting device 6 including the collecting unit 63 having the plate-shaped air-permeable member 66 configured as described below. As a comparative example, an image forming apparatus combined with the particle collecting device 6 to which the collecting unit 63 is not attached is prepared.

As the plate-shaped air-permeable member 66, an aluminum filter having a thickness D of 6 mm and having a honeycomb structure such that the number of the cells 65, each having a substantially hexagonal cross-sectional shape, is approximately 950 is used. In the particle collecting device 6, the total area of a portion of the air-permeable member 66 of the collecting unit 63 that comes into contact with air is 14400 $mm^2$. In the particle collecting device 6, the axial fan, which is the airflow generating unit 62, is rotated so that the airflow rate on a side (upstream side) of the air-permeable member 66 into which air flows is 0.33 $m^3$/min. The particle collecting device 6 is operated for a period from the start to the end of the image forming operation in the test.

An image formed in the image forming operation is a chart having an image area ratio of 5%, which is designated by Blue Angel (BA). As the fixing device 5, a device that performs a fixing operation at a fixing-heating temperature in the range of 150 to 180° C. is used. As the toner, a toner composed of resin, pigment, wax particles, and the like is used.

Figure 6:
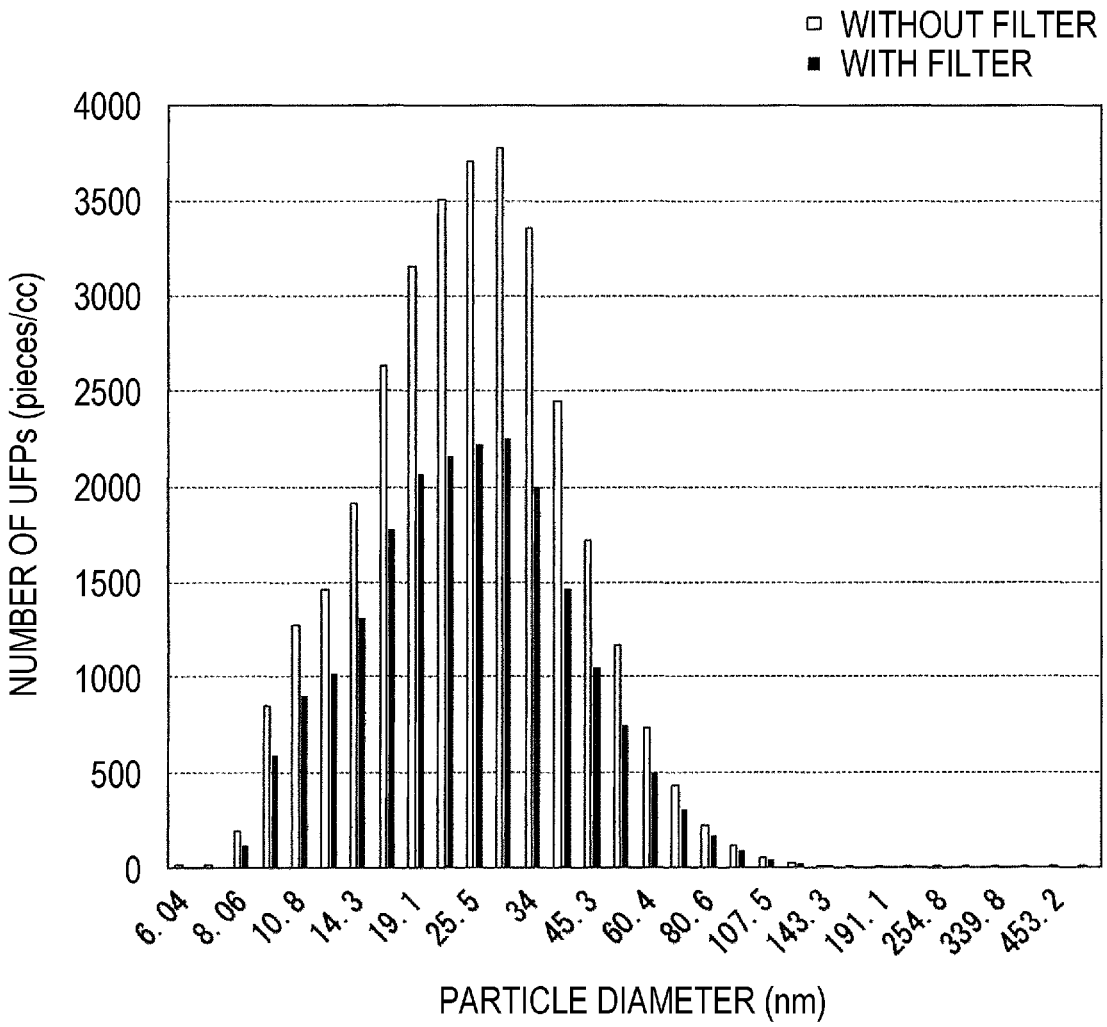
FIG. 6 is a graph illustrating the result of a test of examining the relationship between the particle diameter and the amount of ultra-fine particles, which indicates the collection efficiency of the particle collecting device.

In the test T1, the relationship between the particle diameter and the number of ultra-fine particles (number of UFPs) is examined. FIG. 6 shows the result.

In the test T1, the image forming apparatus according to the comparative example (including the particle collecting device 6 to which the collecting unit 63 is not attached) is also tested under the same conditions.

From the result shown in FIG. 6, it can be seen that, in a case where the image forming apparatus including the particle collecting device 6 to which the plate-shaped air-permeable member 66 having the honeycomb structure is attached (with a filter) is used, the amount of UFPs having a particle diameter of 100 nm or smaller is reduced, compared with a case where the image forming apparatus according to the comparative example (without a filter) is used.

Figure 7:
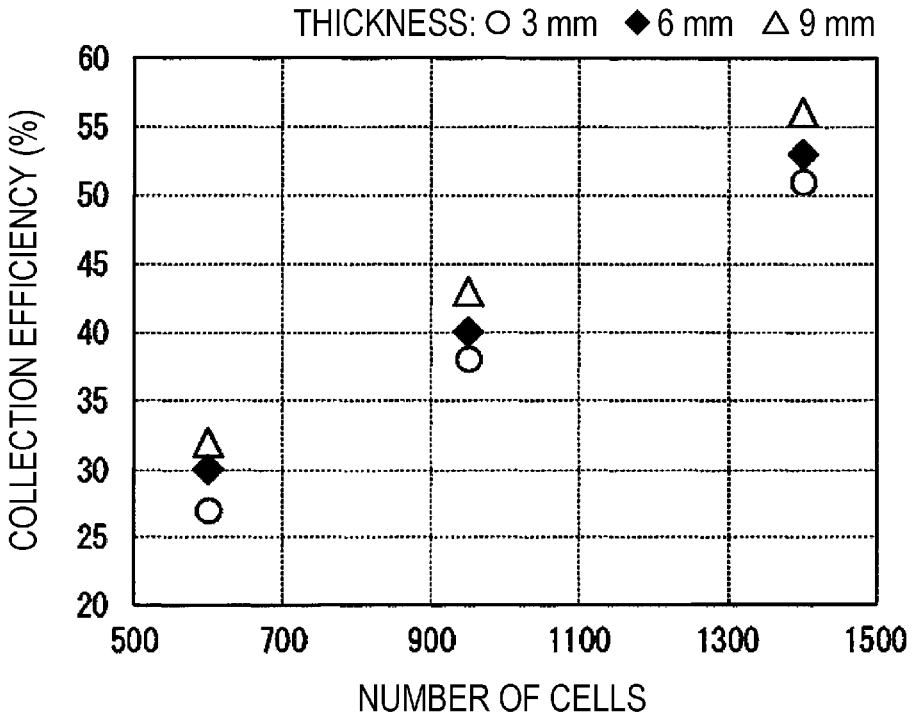
FIG. 7 is a graph illustrating the result of a test of examining the relationship among the number of cells of a honeycomb structure of the air-permeable member, the thickness of the air-permeable member, and the ultra-fine-particle collection efficiency.

Next, regarding the air-permeable member 66 of the collecting unit 63 that can reduce the amount of UFPs, the test T1 is performed to examine the relationship among the number of the cells 65 of the air-permeable member 66, the thickness D of the air-permeable member 66, and the UFP collection efficiency. FIG. 7 shows the result of the test T1.

The test T1 is performed as follow: the plate-shaped air-permeable members 66, which are aluminum filters having different numbers of cells 65 and different thicknesses D, are prepared; and the UFP collection efficiency when the air-permeable members 66 are replaced with each other and each attached to the particle collecting device 6 is measured.

Nine air-permeable members 66 having the following combinations are prepared: the numbers of cells 65 was 600, 950, and 1400; and the thicknesses D of the air-permeable members 66 was 3 mm, 6 mm, and 9 mm as shown in FIG. 7.

The collection efficiency is the difference in percent between the UFP amount when each of the air-permeable members 66 is present and the UFP amount when the air-permeable member 66 is not present, and also corresponds to the UFP reduction ratio.

From the result shown in FIG. 7, it can be seen that the UFP collection efficiency gradually increases as the number of the cells 65 per square inch increases. From the result, it can be also seen that, for the same number of cells, the UFP collection efficiency gradually increases as the thickness D of the air-permeable member 66 increases.

Therefore, it can be said that, in the air-permeable member 66, having a honeycomb structure, of the collecting unit 63, there is a substantially proportional correlation between the number of the cells 65 and the thickness D the air-permeable member 66 and the UFP collection efficiency.

From the result, it can be said that the air-permeable member 66 having a honeycomb structure has an effect of collecting and reducing UFPs, provided that the number of the cells 65 is 600 or larger and 1400 or smaller and the thickness D of the air-permeable member 66 is 3 mm or larger and 9 mm or smaller.

Next, a test T2 is performed to examine the relationship between the number of the cells 65 of the air-permeable member 66, which is the collecting unit 63 of the particle collecting device 6, and the pressure loss.

Figure 8A:
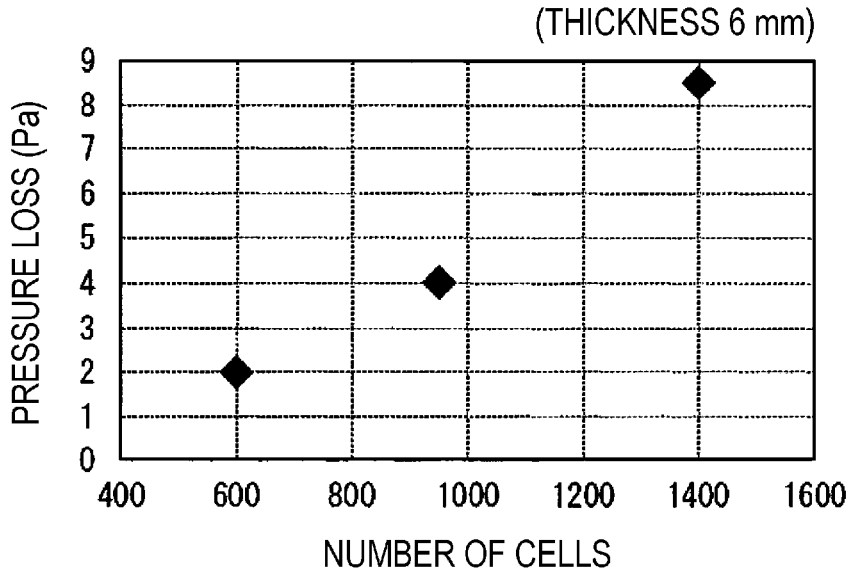
FIG. 8A is a graph illustrating the result of a test T2 of examining the relationship between the number of cells of the honeycomb structure of the air-permeable member and the pressure loss.

FIG. 8A shows the result of the test T2.

In the test T2, the air-permeable members 66 such that the numbers of cells 65 are 600, 950, and 1400 are prepared. The air-permeable members 66 are the same as the aluminum filters used in the test T1, and each has a thickness D of 6 mm.

In the test T2, the pressure loss is measured as follows: in the particle collecting device 6, the air-permeable members 66 such that the numbers of cells were the aforementioned values are replaced with each other and each set in the air pipe 61; airflow of a predetermined flow rate (0.33 $m^3$/min) is generated by the airflow generating unit 62; and the difference between the air pressure (Pa) at a position upstream of the air-permeable member 66 and the air pressure (Pa) at a position downstream of the air-permeable member 66 is obtained as the pressure loss (Pa). The air pressure is measured by using a differential pressure gauge (Model 5122, made by Testo SE & Co.).

From the result shown in FIG. 8A, it can be seen that the pressure loss of the air-permeable members 66 having the aforementioned numbers of cells is in the range of approximately 2 to 8.5 Pa. It can be said that, when the pressure loss is in such a range, the pressure loss is sufficiently suppressed. From the result, it can be also seen that, in the air-permeable member 66, the pressure loss gradually increases as the number of cells increases.

Accordingly, when the results of the test T1 are also taken into account, the particle collecting device 6 can collect UFPs while suppressing pressure loss.

The pressure loss of the particle collecting device 6 may be 6 Pa or smaller, because, in this case, a load applied the axial fan of the airflow generating unit 62 is reduced and the power consumption tends to decrease, and the noise of the axial fan is further reduced.

Next, the test T1 is performed to examine the relationship between the UFP reduction ratio and the airflow rate of the air-permeable member 66 of the collecting unit 63.

Figure 8B:
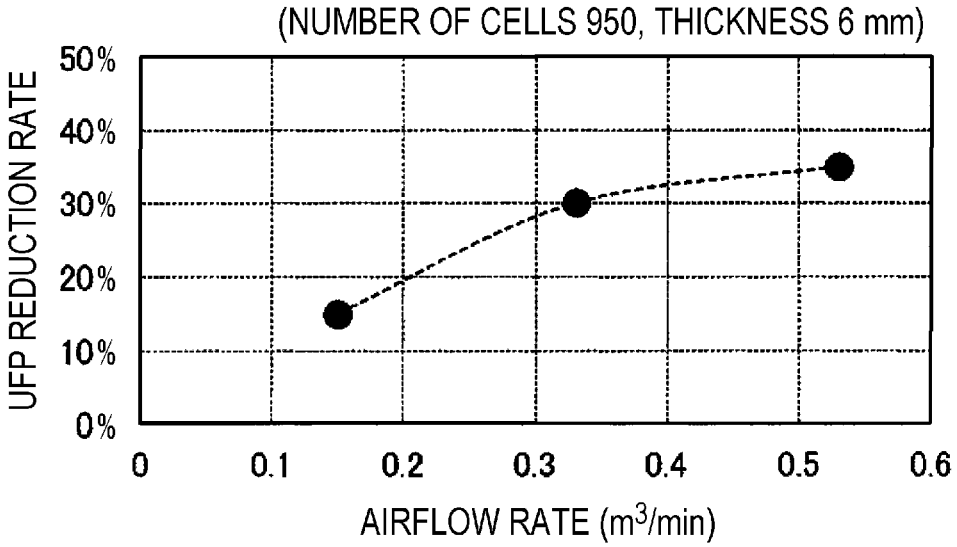
FIG. 8B is a graph illustrating the result of a test of examining the relationship between the ultra-fine-particle reduction ratio of the air-permeable member and the airflow rate.

FIG. 8B shows the result of the test.

In this test, as the air-permeable member 66, an aluminum filter having a honeycomb structure such that the number of cells is 950 is used. The thickness D of the air-permeable member 66 is 6 mm.

In this test, by adjusting the rotation speed of the axial fan of the airflow generating unit 62, the airflow rate on the side of the collecting unit 63 into which air flows is set to 0.15, 0.33, and 0.53 ($m^3$/min). The UFP reduction ratio is obtained in the same way as the collection efficiency is obtained in the test T1.

From the result shown in FIG. 8B, it can be seen that, with the air-permeable member 66 having the aforementioned number of cells, the UFP reduction ratio tends to increase as the airflow rate increases (as the airflow rate increases to 0.2 $m^3$/min or higher).

Because the UFP reduction ratio (collection efficiency) is desirably 300 or higher, in view of this, the airflow rate may be set to approximately 0.3 $m^3$/min or higher. The upper limit of the airflow rate may be set, for example, in view of reduction of operation noise such as noise of the airflow generating unit 62 and the like.

Because an aluminum filter is used as the air-permeable member 66 of the collecting unit 63 in the particle collecting device 6, the air-permeable member 66 is resistant to corrosion and can be used stably for a long time.

In the particle collecting device 6, the plate-shaped air-permeable member 66 of the collecting unit 63 has a honeycomb structure such that the number of the cells 65 per square inch is 600 or larger and 1400 or smaller and the thickness t of the boundary portion 67 between the cells 65 is 0.015 mm or larger and 0.02 mm or smaller. Regarding the honeycomb structure, FIG. 9 illustrates the relationship between the number of cells per square inch and the opening ratio per square inch.

Figure 9:
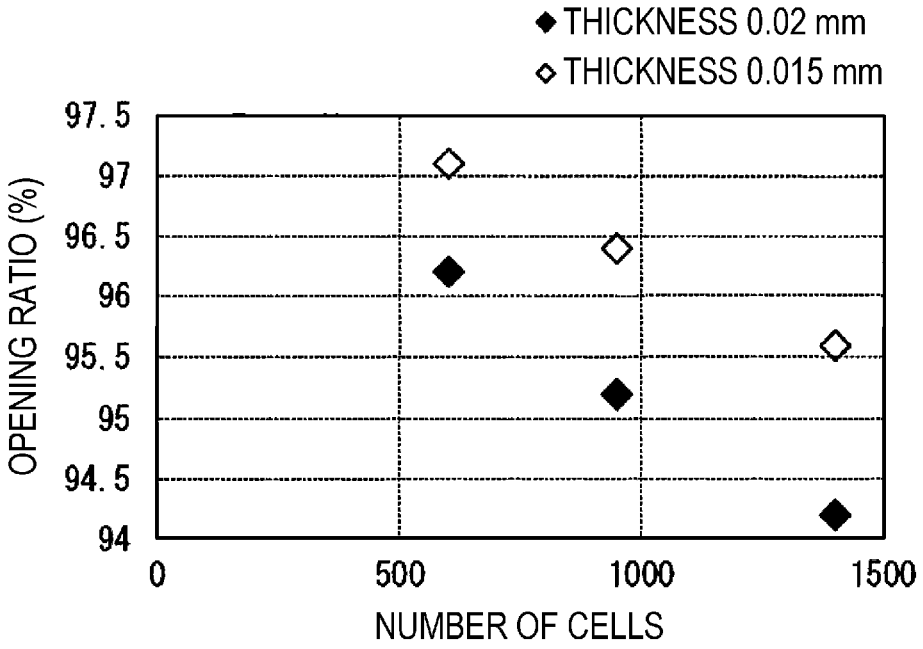
FIG. 9 is a graph illustrating the relationship between the number of cells of the honeycomb structure of the air-permeable member and the opening ratio of the honeycomb structure, for different thicknesses of a boundary portion between the cells.

From the result shown in FIG. 9, regarding the honeycomb structure of the air-permeable member 66 described above, it can be paraphrased that the honeycomb structure has an opening ratio per square inch in the range of the minimum 94.2% to the maximum 97.1%.

Thus, in the particle collecting device 6, the plate-shaped air-permeable member 66 of the collecting unit 63 may have a honeycomb structure such that the opening ratio per square inch is 94.2% or higher and 97.1% or lower. The opening ratio can be measured by using, for example, a method that is the same as the aforementioned method of counting the number of the cells 65 per square inch.

Figure 10:
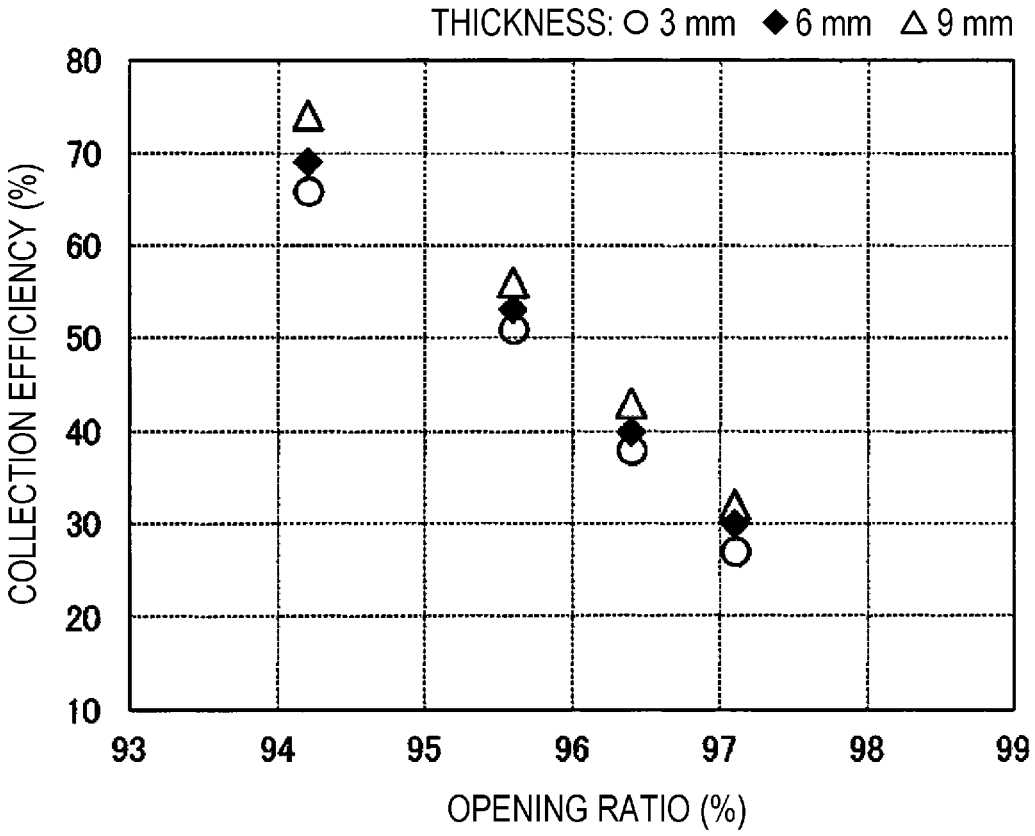
FIG. 10 is a graph re-illustrating the result of FIG. 7 by taking the opening ratio along the horizontal axis.

FIG. 10 is a graph re-illustrating the result shown in FIG. 7, which represents the relationship among the number of the cells 65 of the air-permeable member 66, the thickness D of the air-permeable member 66, and the UFP collection efficiency, by taking the opening ratio, instead of the number of cells, along the horizontal axis.

From the result shown in FIG. 10, it can be seen that the UFP collection efficiency gradually increases as the opening ratio per square inch of the honeycomb structure decreases. It can be also seen from this result that, for the same opening ratio, the UFP collection efficiency tends to gradually increase as the thickness D of the air-permeable member 66 increases.

Therefore, it can be seen that, with the air-permeable member 66, having a honeycomb structure, of the collecting unit 63, there is a substantially proportional correlation between the thickness D of the air-permeable member 66 and the UFP collection efficiency, while it can be also said that there is a substantially inversely-proportional correlation between the opening ratio per square inch and the UFP collection efficiency.

Modifications

The present disclosure is not limited to the contents described as examples in the exemplary embodiment and may be modified in various ways within the sprit and scope of the present disclosure described in the claims. For example, the present disclosure includes the following modifications.

In the exemplary embodiment, an aluminum filter is descried as an example of the plate-shaped air-permeable member 66 of the collecting unit 63. However, as long as the air-permeable member 66 can have a desirable honeycomb structure, an air-permeable member made of a metal other than aluminum or a material other than metal may be used.

In the exemplary embodiment, the particle collecting device 6 includes the airflow generating unit 62. However, the particle collecting device 6 need not include the airflow generating unit 62 if the particle collecting device 6 is used in combination with an air discharging unit that generates airflow by using an air-discharge fan or the like. A blower other than an axial fan may be used as the airflow generating unit 62.

In the exemplary embodiment, the particle collecting device 6 is used to collect particles, including ultra-fine particles, generated in the fixing device 5 of the image forming apparatus 1. However, the particle collecting device 6, which is a device that collects ultra-fine particles, may be used in combination with an air discharging unit that sucks and discharges air including ultra-fine particles generated by a device other than the fixing device 5 of the image forming apparatus 1.

A particle collecting device according to the present disclosure can be used in an apparatus other than an image forming apparatus for which ultra-fine particles need to be collected.

An image forming apparatus in which the particle collecting device 6 is used is not limited to the image forming apparatus 1 described as an example in the exemplary embodiment, and may be another type of image forming apparatus using an electrophotographic method (including a multicolor image forming method). Further alternatively, an image forming apparatus in which the particle collecting device 6 is used may be an image forming apparatus using an image forming method other than an electrophotographic method (such as a liquid jet method, a printing method, or the like).

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A particle collecting device comprising:

an air pipe having a flow space in which air including particles flows; and a collecting unit that is disposed in such a way as to block the flow space of the air pipe and that collects the particles included in the air, wherein the collecting unit is a plate-shaped air-permeable member having a honeycomb structure such that a number of cells per square inch is 600 or larger and 1400 or smaller, wherein a thickness of the air-permeable member is 3 mm or larger and 9 mm or smaller.

2. The particle collecting device according to claim 1, wherein a thickness of a boundary portion between the cells of the honeycomb structure is 0.015 mm or larger and 0.02 mm or smaller.

3. The particle collecting device according to claim 2, wherein the air-permeable member is made of aluminum.

4. The particle collecting device according to claim 1, wherein the air-permeable member is made of aluminum.

5. The particle collecting device according to claim 1, comprising:

an airflow generating unit that generates airflow that causes the air to flow in the flow space of the air pipe in a direction in which the air is to be moved, wherein the airflow generating unit comprises a fan, wherein the airflow generating unit operates so that an airflow rate on a side of the air-permeable member into which the air flows is 0.2 $m^3$/min or higher.

6. The particle collecting device according to claim 1 comprising:

an airflow generating unit that generates airflow that causes the air to flow in the flow space of the air pipe in a direction in which the air is to be moved, wherein the airflow generating unit comprises a fan, wherein the airflow generating unit operates so that an airflow rate on a side of the air-permeable member into which the air flows is 0.2 $m^3$/min or higher.

7. An image forming apparatus comprising:

an air discharging unit that sucks air that is present in an apparatus body and discharges the air, wherein the air discharging unit comprises a duct, wherein the particle collecting device according to claim 1 is disposed in combination with the air discharging unit.

8. A particle collecting device comprising:

an air pipe having a flow space in which air including particles flows; and a collecting unit that is disposed in such a way as to block the flow space of the air pipe and that collects the particles included in the air, wherein the collecting unit is a plate-shaped air-permeable member having a honeycomb structure such that an opening ratio per square inch is 94.2% or higher and 97.1% or lower.

9. The particle collecting device according to claim 8, wherein a thickness of the air-permeable member is 3 mm or larger and 9 mm or smaller.

10. The particle collecting device according to claim 8, wherein a thickness of a boundary portion between the cells of the honeycomb structure is 0.015 mm or larger and 0.02 mm or smaller.

11. The particle collecting device according to claim 10, wherein the air-permeable member is made of aluminum.

12. The particle collecting device according to claim 8, wherein the air-permeable member is made of aluminum.

13. The particle collecting device according to claim 8, comprising:

an airflow generating unit that generates airflow that causes the air to flow in the flow space of the air pipe in a direction in which the air is to be moved, wherein the airflow generating unit comprises a fan, wherein the airflow generating unit operates so that an airflow rate on a side of the air-permeable member into which the air flows is 0.2 $m^3$/min or higher.

14. A particle collecting device comprising:

an air pipe having a flow space in which air including particles flows; and a collecting unit that is disposed in such a way as to block the flow space of the air pipe and that collects the particles included in the air, wherein the collecting unit is a plate-shaped air-permeable member having a honeycomb structure such that a number of cells per square inch is 600 or larger and 1400 or smaller, wherein a thickness of a boundary portion between the cells of the honeycomb structure is 0.015 mm or larger and 0.02 mm or smaller.

15. A particle collecting device comprising:

an air pipe having a flow space in which air including particles flows; and a collecting unit that is disposed in such a way as to block the flow space of the air pipe and that collects the particles included in the air, wherein the collecting unit is a plate-shaped air-permeable member having a honeycomb structure such that a number of cells per square inch is 600 or larger and 1400 or smaller, wherein the air-permeable member is made of aluminum.

16. A particle collecting device comprising:

an air pipe having a flow space in which air including particles flows;

a collecting unit that is disposed in such a way as to block the flow space of the air pipe and that collects the particles included in the air, wherein the collecting unit is a plate-shaped air-permeable member having a honeycomb structure such that a number of cells per square inch is 600 or larger and 1400 or smaller; and an airflow generating unit that generates airflow that causes the air to flow in the flow space of the air pipe in a direction in which the air is to be moved, wherein the airflow generating unit comprises a fan, wherein the airflow generating unit operates so that an airflow rate on a side of the air-permeable member into which the air flows is 0.2 $m^3$/min or higher.

17. An image forming apparatus comprising:

an air discharging unit that sucks air that is present in an apparatus body and discharges the air, wherein the air discharging unit comprises a duct; and a particle collecting device, the particle collecting device comprising:

an air pipe having a flow space in which air including particles flows; and a collecting unit that is disposed in such a way as to block the flow space of the air pipe and that collects the particles included in the air, wherein the collecting unit is a plate-shaped air-permeable member having a honeycomb structure such that a number of cells per square inch is 600 or larger and 1400 or smaller, wherein the particle collecting device is disposed in combination with the air discharging unit.

* * * * *